US005664377A

United States Patent [19]

Angelo et al.

[11] Patent Number: 5,664,377

[45] Date of Patent: Sep. 9, 1997

[54] APPARATUS AND METHOD TO A GROUND SURFACE FOUNDATION

[76] Inventors: Arthur Angelo, 17720 St. Andrews Dr., Poway, Calif. 92064; Kambozia S. Naraghi, 13455 Bavarian Dr., San Diego, Calif. 92129

[21] Appl. No.: 274,789

[22] Filed: Jul. 14, 1994

[51] Int. Cl.[6] ..... E02D 27/32

[52] U.S. Cl. ..... 52/295; 52/250; 52/292; 52/299; 52/742.14

[58] Field of Search ..... 52/166, 299, DIG. 11, 52/292–298, 250–252, 319, 741.1, 742.1, 742.13, 742.14; 405/233, 244; 249/1, 10, 61

[56] References Cited

U.S. PATENT DOCUMENTS

| | | | |
|---|---|---|---|
| 3,115,226 | 12/1963 | Thompson | 52/166 |
| 3,335,531 | 8/1967 | Grimelli et al. | 52/166 |
| 4,064,668 | 12/1977 | Carter | 52/295 |
| 4,689,926 | 9/1987 | McDonald | 52/169.11 |
| 4,799,348 | 1/1989 | Brami et al. | 52/742 |
| 4,817,353 | 4/1989 | Woods et al. | 52/295 |
| 4,976,077 | 12/1990 | Tucker | 52/299 X |
| 5,224,321 | 7/1993 | Fearn | 52/742 |
| 5,271,203 | 12/1993 | Nagle | 52/725 |

*Primary Examiner*—Carl D. Friedman
*Assistant Examiner*—Beth A. Aubrey
*Attorney, Agent, or Firm*—L. Arnold Thaxton

[57] ABSTRACT

There is disclosed a new and improved apparatus and method for forming a cast-in-place and on-the-ground support system. The support system is especially useful in maintaining a levelled and secure undercarriage structure for dwellings. The support system consists of unitized foundation assemblies. A given assembly is comprised of a flexible fabric container, disposed to ground surface, that contains a cementitious material or binder having a pier partly embedded within the cementitious material. There is further disclosed a new and useful foundation assembly for a perimeter beam which is comprised of a flexible fabric container, situated on ground surface, that is furnished with a cementitious material having a stanchion partially embedded within the cementitious material.

8 Claims, 3 Drawing Sheets

APPARATUS AND METHOD TO A GROUND SURFACE FOUNDATION

FIELD OF THE INVENTION

This invention is directed to an apparatus and method of establishing cast-in-place and on-ground-surface foundations. A bottom portion of a building support pier or stanchion is partially embedded in a cementitious material that has been poured into a flexible fabric or geo-textile container. The inosculated assembly is intended to provide a ground surface foundation primarily, although not exclusively, to mobile homes or modular dwellings.

BACKGROUND OF THE INVENTION

The use of flexible fabric for foundation forms renders it possible to produce and maintain a very level building foundation, and to produce such a foundation on sloping and/or underlying terrain. The flexible forms permit a foundation to conform to the underlying surface contour of ground matter, when such ground matter is somewhat irregular.

The use of flexible fabric forms are known in the building construction art as disclosed by R. Fearn in U.S. Pat. No. 5,224,321. The patentee sets forth a method of preparing a sub-wall foundation using a pair of separate rigid forms connected at their bottom end by a fabric sling. A concrete is used to fill the combined fabric and rigid form to the extent that, when hardened, a building structure is readied with a sub-wall foundation situated on ground surface. The patent further discloses the use of a vertical reinforcement rod partially situated in the fabric form and surrounded by concrete.

In one embodiment to the R. Fearn patent, a concrete foundation is seen to extend from ground surface upward to abut a floor assembly, thus, producing an exterior or perimeter sub-wall. However, the patented devices are not revealing or suggestive of an assembly wherein a metal support pier, tubular stanchion, or seismic cradle upright is partially embedded in a fabric container and held with a binder or cementitious material.

Cognizant of the significant need in the building construction industry for a reliably sturdy, relatively inexpensive, and quickly assembled ground surface foundation, the inventors have now discovered a new and improved apparatus that achieves such purposes.

As is well known in the art, mobile homes and modular housing units contain longitudinal support beams or joists as part of their undercarriage structure. By means of support piers, such buildings are typically levelled on site by diversely raising or lowering the support piers. The assembly of the fabric container, hardened cementitious material, and selected upright support of the present invention, is adapted as a ground surface foundation that completely maintains the supporting beams in a levelled position after the original and temporary support piers have been removed.

Accordingly, it is a general object of this invention to provide a new and improved apparatus and method for casting cementitious or concrete foundations by using a flexible fabric container, also referred to as a geo-textile bag, to hold and form the cementitious slurry wherein the bottom part of a support pier, tubular stanchion, or upright to a seismic cradle is embedded in the slurry while the top part of the pier, tubular stanchion, or upright is engaged with the floor beam of the dwelling's underside structure.

Another object of this invention is to provide a new and improved apparatus and method, as set forth in the preceding general object, wherein multiple support piers, tubular stanchions, or seismic cradle uprights may be arranged in series within a single fabric container.

In yet another object of the present invention to provide a new and improved apparatus and method, as set forth in the two preceding objects, wherein the flexible fabric container, itself, is recessed from three to six inches below ground surface.

It is a further object of the present invention to provide a new and improved apparatus and method of setting cast-in-place building foundations that exhibit high structural integrity, is relatively inexpensive to perform, and display a high degree of resistance to ground tremors and heavy winds.

Several preferred embodiments of the invention are shown by way of example in the accompanying drawings and are described in detail without attempting to show all of the various forms and modifications in which the invention might be embodied. Other objects and advantages of the invention will be reflected in the drawings and concomitant written description.

SUMMARY OF THE INVENTION

The present invention provides a new and improved apparatus and method of producing cast-in-place and, generally, on-ground-level building foundations. The objects of this invention are achieved when vertical supports such as construction piers, tubular stanchions, or the vertical support portions of seismic cradles, are engaged at their top end, to a mobile dwelling or modular housing undercarriage support structure. At this juncture, the pier base, stanchion, or seismic cradle vertical support bottom end is suspended several inches above ground surface. A cementitious slurry is poured into the fabric container located on ground surface and directly beneath a selected vertical support, to the extent that the bottom end of the vertical support is embedded within the slurry. Hence, upon hardening of the cementitious material, there is accomplished a cast-in-place foundation comprising a cementitious material and the selected vertical support. The invention contemplates further comprising the fabric container.

Preferred embodiments, along with related embodiments of the present invention, are illustrated by way of examples in the accompanying drawings. Each example is described in detail without attempting to express all of the various forms and modifications in which the invention may be embodied; the invention being measured by the appended claims and not by the details of the specification.

DETAILED DESCRIPTION OF THE INVENTION

Figure 1:
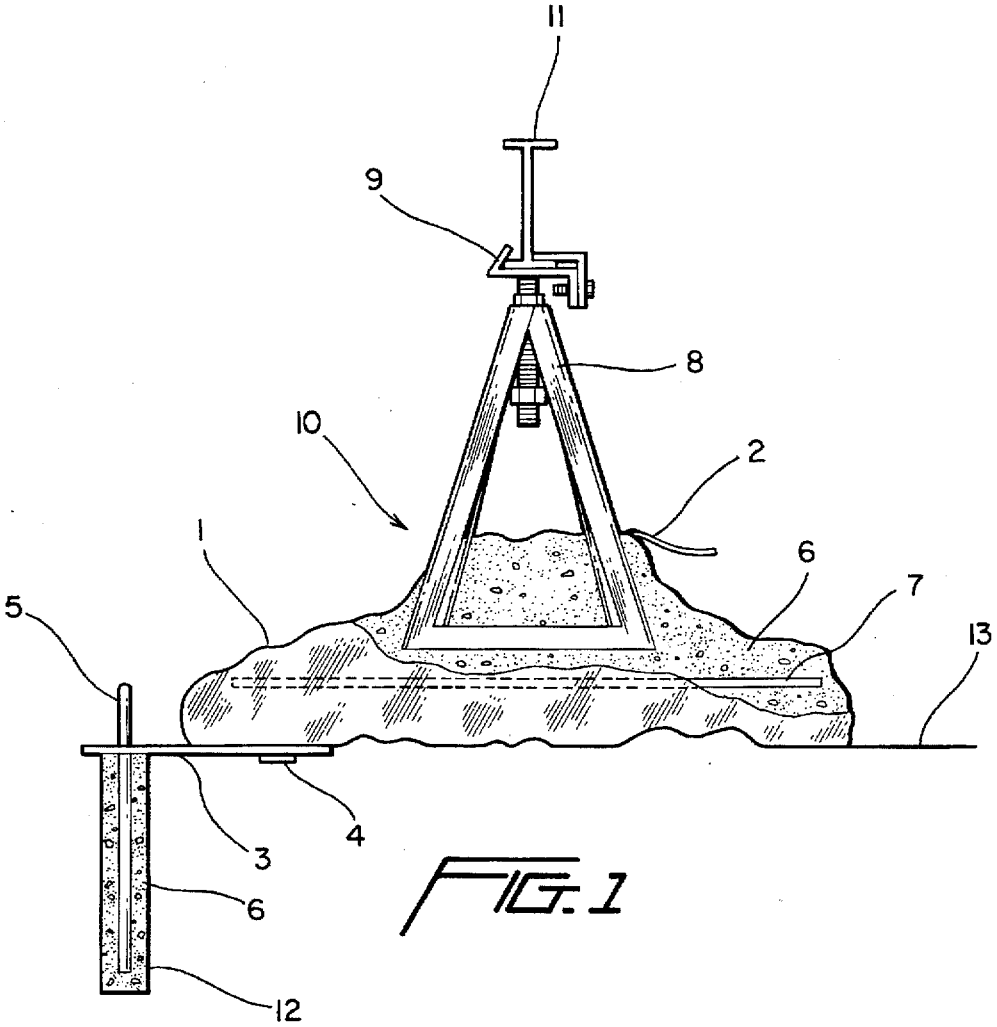
FIG. 1 is a side elevational view, partially in section, illustrating a footing foundation in accordance with the present invention and its method of use with a support pier and ground anchoring means.

The present invention provides a ground surface cast-in-place foundation assembly adapted to vertically engage an underside support beam of a dwelling comprising a pier assembly that includes a pier having an upper and lower end, a base fixedly connected to the lower end of the pier, and means for connecting the upper end of the pier to the support beam; and a flowable and settable foundation material which envelops at least a portion of the assembly, wherein the foundation material conforms to the shape of a porous fabric container into which it is poured, and it sets with the enveloped portion of the pier assembly embedded therein. For purposes of this invention "pier" means any vertical member used to support the undercarriage beams of dwellings and includes piers with one or more legs and the vertical supports of seismic or earthquake cradles. For purposes of this invention "beam connection means" includes welds, clamps, fasteners, bolts, and clips. For purposes of this invention "flowable and settable foundation material" means any material utilized for stabilizing vertical support members including cement, mortar and slurries which contain such materials.

In a preferred embodiment to the invention, the foundation assembly further comprises the container into which the flowable and settable foundation material is poured, the container comprising a porous fabric unibody defining an entrance and having an inner and outer surface, a portion of the outer surface in contact with the ground surface; and means for securing the container to the pier, wherein the base and the foundation material are introduced into the container through the entrance so the foundation material contacts the inner surface of the container while enveloping the base when it is poured through the entrance, whereby the ground, container, and container securing means restrains the foundation material from flowing after it is poured into the container. For purposes of this invention, means for securing the container to the pier may be on the pier, the container, or both and includes bolts, screws, hook and loop configurations, and drawstrings. In another preferred embodiment to the invention, the foundation assembly further comprises means for anchoring the foundation assembly, wherein the anchoring means is fixedly connected to the foundation material. For purposes of this invention "means for anchoring" includes steel plates to which the foundation material is bolted or screwed to, as well as, bolts and rebars embedded in the ground and secured to the foundation material.

In yet another preferred embodiment of the invention, the beam connection means comprises a beam clamp; a vertical member having an upper and lower end, the upper end being fixedly attached to the beam clamp; and means for fixedly attaching the lower end of the vertical member to the pier. For purposes of this invention "beam clamp" means any beam clamp which fixes itself to the beam and includes multi-piece clamps and clamps which do or do not require the beam to be compromised by drilling holes therein.

In another preferred embodiment of the invention, the container is elongated in construction and defines at least two entrances situated on the same side of the container, each entrance disposed to receive a pier assembly and foundation material.

The present invention also provides a ground surface cast-in-place foundation assembly adapted to vertically engage a perimeter beam of a dwelling comprising means for seating the perimeter beam; a tubular stanchion having an aperture, the seating means fixedly attached to the stanchion above the aperture; and a flowable and settable foundation material, wherein the foundation material is introduced into the tubular stanchion through the aperture and flows into a porous fabric container whose entrance is securely fitted around the stanchion below the aperture so that the lower portion of the stanchion is embedded into the foundation material which resides in the container after being introduced therein. In a preferred embodiment of the invention, the foundation assembly further comprises the porous fabric container. In another preferred embodiment of the invention, the foundation assembly further comprises a rotatively detachable spout having a first and second end, the first end positioned above a horizontal plane that the beam seating means is on, and the second end rotatively connected to the wall of the stanchion which defines the aperture.

The present invention provides a ground surface cast-in-place foundation assembly adapted to vertically engage a support beam of a dwelling comprising; a vertical member having an upper and lower end; means for connecting the upper end of the vertical member to the support beam; a flowable and settable foundation material into which the lower end of the vertical member is embedded; and a container into which the foundation material is poured, the container comprising a porous fabric unibody and means for securing the container to the vertical member, the ground and container means restraining the foundation material from flowing after it is poured into the container. In a preferred embodiment of the invention the means for securing the container is a drawstring.

The present invention provides a method for installing a ground surface cast-in-place foundation assembly adapted for engaging beams of a dwelling comprising securing a vertical support assembly to a beam wherein the bottom portion of such assembly hovers above the ground surface; pouring a flowable and settable foundation material into a suitable fabric container which resides on the ground surface; positioning the vertical support assembly inside the fabric container; and securing the fabric container to an intermediate portion of the vertical support assembly wherein the lower portion of the assembly is embedded in the foundation material in the container.

The present invention provides a method for installing a ground surface cast-in-place foundation assembly adapted for engaging beams to the underside of a dwelling comprising securing a vertical support assembly to a beam such that a bottom portion of the assembly hovers above the ground surface; securing a fabric container around and to the vertical support assembly, wherein the secured container defines an aperture higher than the horizontal plane on which the lowest portion of the assembly hovers and its bottom contacts the ground surface; and pouring an amount of a flowable and settable material through the aperture suitable to embed the lower portion of the assembly into the foundation material in the container.

The present invention provides a container for receiving flowable and settable foundation material and one or more vertical members comprising a porous fabric material defining an entrance for receiving the vertical member and the foundation material; and means for securing the container to the vertical member wherein the container and container securing means restrains the foundation material from flowing after it is poured into the container. In a preferred embodiment of the invention, the means for securing the container is a drawstring.

DESCRIPTION OF THE PREFERRED EMBODIMENTS

In accordance to the invention, a mobile home or modular dwelling is delivered to a selected construction site and levelled above ground surface by strategically placing construction piers throughout the undercarriage support beams. The cast-in-place and generally on ground foundations that more securely support the levelled building, and which incorporate the concepts of the present invention, are designated by the numerals 10, 20, 30, 40, 50, and 60 in the attached drawings.

In a preferred embodiment depicted in FIG. 1, the novel and improved foundation 10 is comprised of a two-part clamp 9 contiguous at the apex of an adjustable pier 8. Clamp 9 is secured to an undercarriage beam 11 such that the base portion of pier 8 is suspended several inches above ground surface 13. Fabric container 1 is temporarily placed immediately beneath pier 8 in order to assess and mark an optimal position at which plate 3 will be located for anchoring container 1. After removing container 1, the worker is able to dig a hole 12, on the mark, that is approximately five inches in diameter and ten to fifteen inches in depth. Plate 3, designed to help anchor container 1, is positioned onto surface 13 to the degree that an aperture (not shown) occurring at one end of plate 3, is centered over hole 12. At the opposite end of plate 3, bolt 4 is disposed in an upright position to surface 13. Container 1 is relocated beneath pier 8 and appropriately punctured by bolt 4. A concrete slurry 6 is poured into container 1 to about one-third the capacity thereof. One or more rods or rebars 7 are horizontally arranged on top of slurry 6 for their well known reinforcement purposes. The upper end or entrance to container 1 is pulled up and over the base portion of pier 8 and secured in a chosen position about the legs of pier 8 with a drawstring 2. Slurry 6 is further introduced into container 1 until it is about one inch below the level of drawstring 2. Plate 3, at this juncture, can be move laterally, and is thus, swiveled away from hole 12 to permit the filling of hole 12 with other of slurry 6. Plate 3 is relocated over hole 12 followed by the vertical insertion of rebar 5 through the aperture and into slurry 6.

Plate 3 and rebar 5 unite to securely anchor foundation 10 against movement on surface 13 during the occasion of heavy winds and/or ground vibrations, such as earthquakes or nearby heavy construction efforts, such as blasting, pile-driving, and the like.

Figure 2:
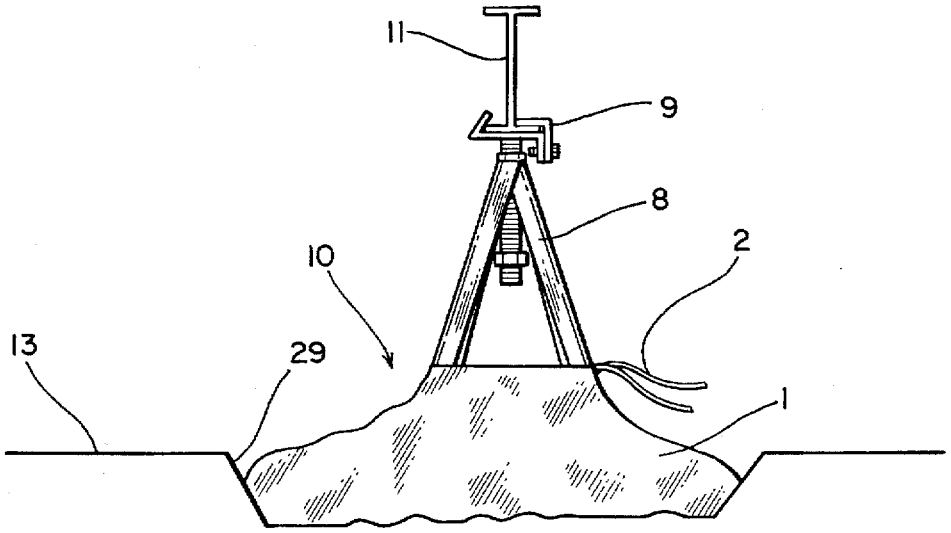
FIG. 2 is a side elevational view, of the general structure to FIG. 1, showing the foundation assembly slightly recessed within ground matter.

In accordance to this invention, an alternate arrangement, from that expressed in FIG. 1, is illustrated in FIG. 2, where foundation 10 is identical in construction but functions without plate 3 and rebar 5, while using ground matter itself as the anchoring feature to foundation 10. Foundation 10, of FIG. 2, is cast-in-place within a shallow hole 29 that is about three to five inches below ground surface 13. In lieu of anchor plate 3 and rebar 5 being wedded to hole 12 as shown in FIG. 1, hole 29 of FIG. 2 serves to inhibit the movement of foundation 10 on the occurrence of heavy winds and/or ground tremors.

Figure 3:
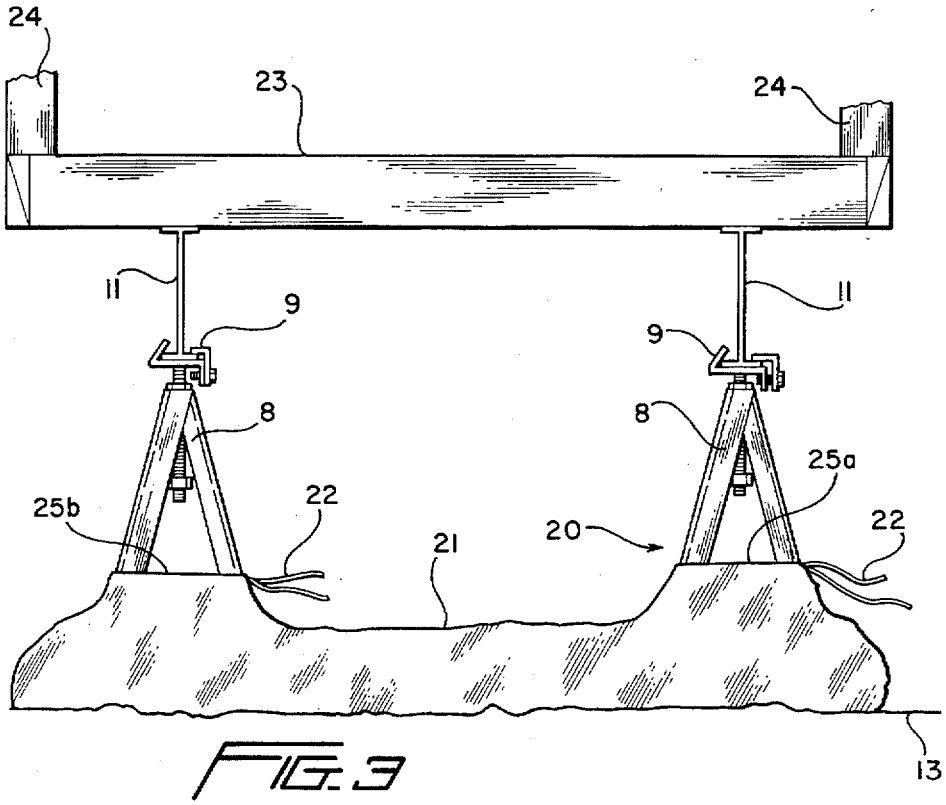
FIG. 3 is a side elevational view of a second embodiment to this invention where a single fabric container is seen to accommodate two support piers for a building structure.

Referring now to FIG. 3, wherein a related embodiment to the present invention is illustrated as having a foundation 20, integrally supporting a floor assembly 23 and building walls 24. Foundation 20 is comprised of an oblong/fabric container 21, having identical protruding entrances **25*a*, 25*b*, for receiving vertical supports, binder material, and reinforcement rods, disposed on the same side of container 21 but at opposite ends to one another. For the moment, container 21 is placed on surface 13, with its entrances 25*a*, 25*b* immediately beneath the base portion of piers 8. Two-part clamps 9, located at the apex of piers 8, tightly engage the bottom flanges of parallel beams 11. A slurried binder or cementitious material, such as slurry 6, is poured into each entrance 25*a* and 25*b* until container 21 ia about one third filled. Several rebars 7 are inserted through entrances 25*a*, 25*b* and are horizontally positioned on top of concrete slurry 6. After rebars 7 are in position, entrances 25*a* and 25*b* are drawn up the legs of each pier 8, to a position several inches above the base portion of each pier 8 and held in place by tying each of drawstrings 2 around the legs to piers 8. Slurry 6 is poured into entrances 25*a*, 25*b* until slurry 6 is about one inch below the level of each drawstring 22**.

Figure 4:
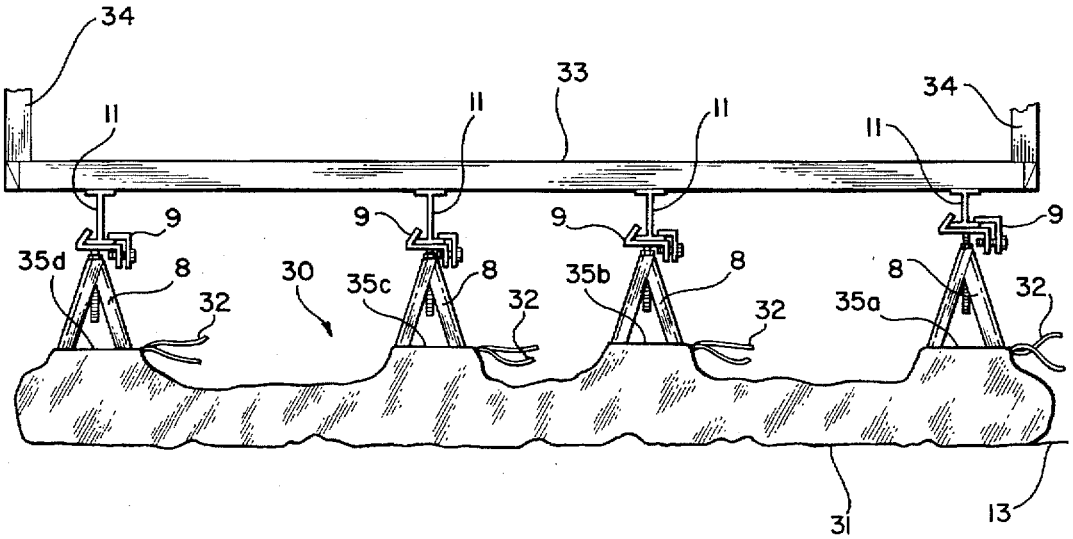
FIG. 4 is a schematic illustration to an example of another embodiment, in accordance with this invention, where multiple support piers are suitably lodged in a single fabric container.

Another embodiment to this invention is shown in FIG. 4, wherein a footing foundation 30 is comprised of an elongated fabric container 31 having protruding entrances **35*a* and 35*d* situated on the same side of container 31, but at opposite ends thereof, while entrances 35*b* and 35*c* are intermediately disposed relative to entrances 35*a* and 35*d*. Operationally, foundation 30 is assembled in the same fashion as that of foundation 20. In its assembled state, foundation 30 is supportive to floor assembly 33 and building 34**.

Each of the foundations represented by FIGS. 1 to 4 and designated by the numerals 10, 20, and 30 have been determined to be useful as support foundations for beams or joists that extend out from and beneath the flooring assemblies 23 and 33. Such extensionsbeams or joists are typically found interposed between the perimeter joists that are an integral part of flooring assemblies 23 and 33. Thus, it has been assessed that the two-part clamp 9 feature of pier 8 is a somewhat undersirable fastener for the perimeter joists themselves, since foundation integrity is more easily compromised in comparison to, here discovered, a new and improved foundation arrangement.

Figure 5:
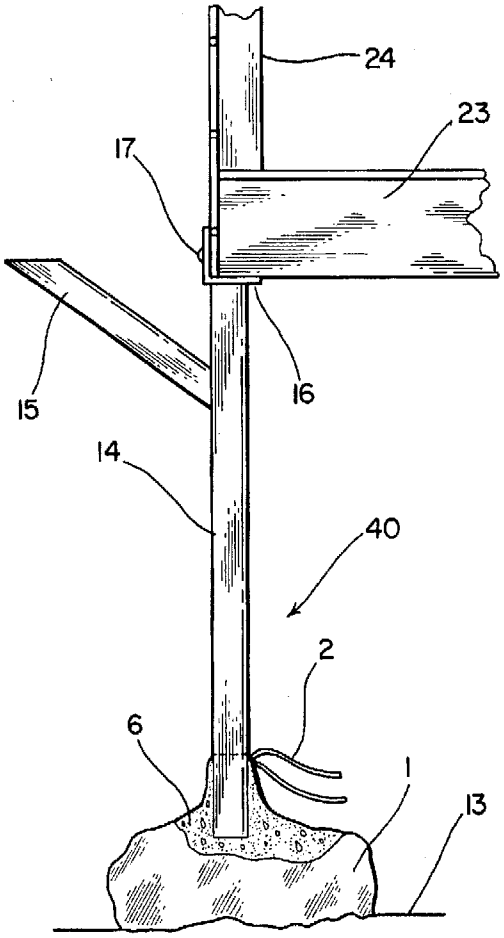
FIG. 5 is a side elevational view of still another related embodiment to this invention, partly in section, showing a cementitiously filled container co-operating with a tubular stanchion in support of a building structure.

In the latter regard, the related embodiment illustrated in FIG. 5 as foundation 40 functions admirably well in support of perimeter joists or beams, while foundations 10, 20, and 30 are more suitable in their support of undercarriage and interiorly positioned beams. Foundation 40 is comprised of a fabric container 1 housing slurry 6 that partially embeds a tubular stanchion 14, disposed with a lateral and rotatively detachable spout 15 and further equipped with an affixed L-shaped bracket 16. As earlier stated and now repeated for emphasis, the method of this invention is practiced after a mobile home or modular dwelling has been levelled on site. In operation then, the cast-in-place installation of foundation 40 requires measuring the distance between surface 13 and joist 23. That distance minus three to six inches, is equal to the optimal adjusted length of stanchion 14. The use of a tube-cutter may be necessary to produce the optional of stanchion 14, should the initial length be too long. A selected length of stanchion 14 is attached, at its upper end, by attaching bolt 17 through an aperture located in the vertical flange of L-shaped bracket 16, thus, suspending stanchion 14 three to six inches above ground surface 13. While the bottom end of container 1 resides on ground surface 13, the entrance to container 1 is suitably tied around stanchion 14 by means of drawstring 2. A concrete slurry 6 is poured through the spout 15, that is disposed at a forty-five degree angle relative to tube 14, until both container 1 and tube 14 are completely filled. A worker is able to determine when container 1 and stanchion tube 14 are full by observing the refusal of spout 15 to accept any more of slurry 6 after some prodding thereof, as with a small straight object. Since the entrance to spout 15 exists on a horizontal plane that is slightly higher than the bottom flange of bracket 16, the appearance of slurry 6 at the entrance of spout 15 signals that stanchion 14 is completely and sufficiently full to the bottom of L-bracket 16 and within stanchion tube 14. Spout 15 may be rotatively detached from stanchion 14 for cleaning and its subsequent use in the construction of yet another foundation 40. As elsewhere described, container 1, of this embodiment may also be optionally equipped with one or several rebars 7.

Figure 7:
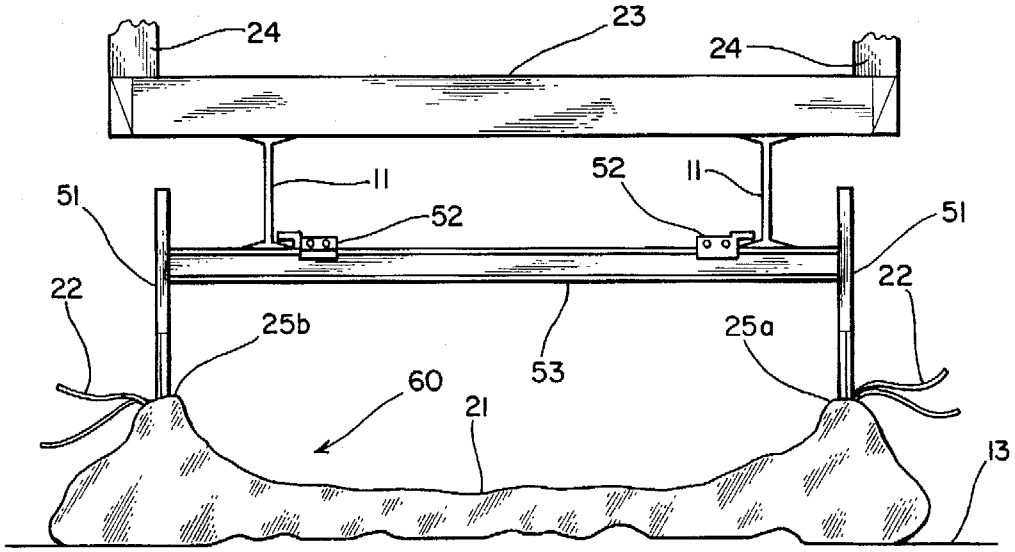
FIG. 7 is a front elevational view to the inventive embodiment shown in FIG. 6, wherein the seismic or earthquake cradle is seen to have each upright partially embedded in an oblong fabric container into which cementitious material has been introduced.

An additionally related embodiment to this invention is shown in FIG. 7, wherein a cast-in-place foundation 60 entails the use of a seismic or earthquake cradle 51 and a fabric container 21 filled with the concrete slurry 6 (not shown). The seismic cradle 51 functions as an auxiliary support system as disclosed in U.S. Pat. No. 5,146,724 and issuing to Arthur Angelo on Sep. 15, 1992. By way of reference to its purpose, the seismic cradle 51 disclosure in the '724 patent is deemed coordinate to this discourse and is incorporated in this disclosure. Through use of C-clamps or the like, the top flange to I-beam 53 is temporarily and abuttingly engaged to the lower flange of I-beam 11 such that each stanchion 51 hovers three to six inches above ground surface 13. With container 21 residing on surface 13 and entrances 25*a*, 25*b* positioned immediately beneath each upright to stanchion 51, slurry 6 poured into each entrance 25*a*, 25*b* until container 21 is about one-third filled. A selected number of rebars 7 are inserted through entrances 25*a*, 25*b* and are horizontally disposed on top of slurry 6. Incremental slurry 6 is poured into entrances 25*a*, 25*b* until slurry 6 is about one inch below the level of each drawstring 22. The C-clamp fasteners may be removed after slurry 6 has properly hardened.

Figure 6:
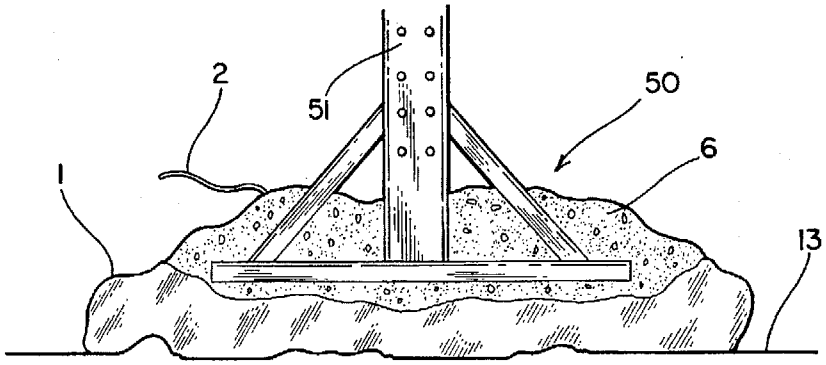
FIG. 6 is a side elevational view of one other related embodiment to this invention, partially in section, and illustrating one upright to a seismic or earthquake cradle embedded in a small fabric bag.

Owe to terrain conditions availability of fabric containers at job-site, and other considerations the construction engineer may determine it more desirable to use a separate flexible container 1 at the base of each stanchion 51 as illustrated in FIG. 6. Thus, a cast-in-place foundation 50 is installed in a similar manner to the installation of foundation 60 of FIG. 7, the sole dissimilarity between foundations 50 and 60 residing in the use of smaller and separate containers 1 for foundation 50 while foundation 60 is comprised of an elongated unibody.

One skilled in the art is able to appreciate that after slurry 6 has sufficiently hardened in each of foundations 10 to 60, all temporary leveling piers are retrieved from the undercarriage structure. Piers 8, stanchions 14, and seismic cradle 51 uprights, as unified members to foundations 10 to 60, function to maintain a levelled mobile or modular building after the temporary piers are removed. It is envisaged that foundations 10, 20, 30, 50, and 60 may be interchangeably disseminated throughout the interiorly arranged undercarriage beams, while foundation 40 is preferably assigned to the building's perimeter beams.

In conformance to current technology, it is appreciated that plate 3, bolt 4, rebars 5, 7, and piers 8, of this invention be constructed of iron, steel, or other formidable material. Fabric containers 1, 21, and 31 are composed of any one of many geo-textile materials well known in the art. It is further contemplated that stanchion 14, spout 15, and L-bracket 16 be constructed of iron, steel, cast aluminum or other appropriately rigid metal, while any or all elements to the seismic cradle be constructed from iron, steel, or similar formidable material.

In view of the foregoing it is apparent that the present invention provides a new and improved apparatus and method of forming cast-in-place, yet ground surface foundations. Moreover, the invention for ground surface foundations has been set forth in language more or less specific in accounting for structural, functional, and component features. Comprehension of the foregoing description is now believed to move an artisan to the appraisal that this invention is not closed to the specific features shown but that means and construction herein disclosed comprise a preferred mode of executing the invention, while numerous modifications of the several embodiments will undoubtedly occur to others of skill and interest in the art, such modifications are deemed pertinent to the spirit of the invention. Thus, the scope of the invention is to be limited solely in light of the appended claims.

We claim:

1. A ground surface cast-in-place foundation assembly adapted to vertically engage the bottom portion of an underside support beam to a dwelling, said assembly comprising:

a pier member having an upper and lower end, fastening means for connecting said upper end to said bottom portion of said beam, a flowable and settable foundation material into which said lower end is embedded, and a geo-textile bag into which said foundation material is disposed, said bag comprising a porous fabric material and having securing means at its entrance wherein said entrance is situated at an intermediate position above said pier lower end, wherein said entrance is secured to said pier with a drawstring.

2. A foundation assembly according to claim 1, wherein a horizontal anchor plate has one end affixed the underside of said bag by means of an upright fastener while the opposing end of said plate is restrained at ground surface.

3. A ground surface cast-in-place foundation assembly adapted to vertically engage the bottom portion of an underside support beam to a dwelling, said assembly comprising:

plural piers, each of which has an-upper and lower end, fastening means for connecting said upper ends to said bottom portion of said beam, a flowable and settable foundation material into which said lower end are embedded, and a geo-textile bag into which said foundation material is disposed, said bag comprising a porous fabric material and a plurality of entrances and having securing means at each of said entrances wherein each of said entrances is situated at an intermediate position above said pier lower ends.

4. A foundation assembly according to claim 3, wherein each of said entrances is secured to each of said piers with a drawstring.

5. A method for installing a ground surface cast-in-place foundation assembly adapted for engaging an underside support beam of a dwelling, said method comprising:

securing a pier, having an upper and lower end, such that said upper end is fastened to the bottom portion, on of said beam while said lower end hovers above ground surface, pouring some flowable and settable material into a suitable geo-textile bag which resides on ground surface, aligning said lower end of said pier within the entrance to said bag, attaching said entrance such that it is intermediately disposed on said pier wherein said lower end to said pier is embedded within said flowable and settable material, and adding more of said flowable material into said bag until said material is immediately below said entrance level.

6. A method according to claim 5, wherein reinforcing rods are horizontally arranged within said flowable material prior to attaching said entrance to said pier.

7. A method according to claim 6, wherein an anchor means engages said foundation assembly to ground surface.

8. A method according to claim 6, wherein a plurality of said piers are attached to said beams and said bag contains plural entrances that are positionally commensurate with each of said pier lower end.

* * * * *